United States Patent [19]

Vogt

[11] Patent Number: 4,581,605

[45] Date of Patent: Apr. 8, 1986

[54] SYSTEM FOR DISPLAYING TIME-RELATED OCCURRENCE OF ALARM-TYPE EVENTS

[75] Inventor: William R. Vogt, Rockaway, N.J.

[73] Assignee: Baker Industries, Inc., Parsippany, N.J.

[21] Appl. No.: 579,745

[22] Filed: Feb. 13, 1984

[51] Int. Cl.[4] ..... G08B 25/00

[52] U.S. Cl. ..... 340/525; 340/526; 340/286 M; 340/506; 340/715

[58] Field of Search ..... 340/525, 526, 500, 506, 340/531–534, 588, 589, 286 R, 286 M, 715, 721, 723, 825.06, 825.55; 179/5 R, 5 P

[56] References Cited

U.S. PATENT DOCUMENTS 3,641,266 2/1972 Stults et al. ..... 340/721
3,793,623 2/1974 Zambuto ..... 340/526
3,806,908 4/1974 Bound et al. ..... 340/525
4,001,807 1/1977 Dallimonti ..... 340/525

*Primary Examiner*—Donnie L. Crosland
*Attorney, Agent, or Firm*—James J. Jennings, Jr.

[57] ABSTRACT

An information display is provided to denote both (1) specific events, such as alarm of a smoke detector or unauthorized entry into a building, and (2) the time elapsed between successive events. The event identification data are stored in conjunction with data representing the time elaspsed since the occurrence of the previous event. The display can be cleared, and reconstituted at a rate related to the original rate at which the events occurred, selected by the viewer. The information regarding events and time differences can be stored and saved in a memory external to the timed-replay portion of the system.

17 Claims, 9 Drawing Figures

UPDATE ROUTINE

FIG. 5 {REPLAY ROUTINE
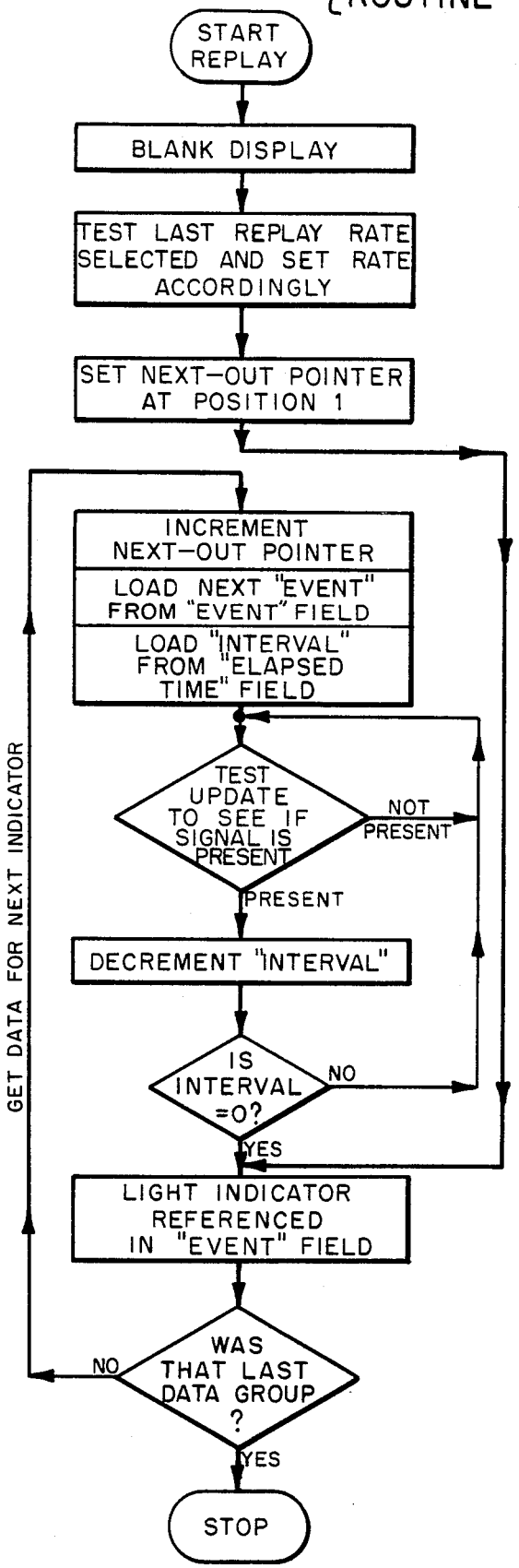
FIG. 4
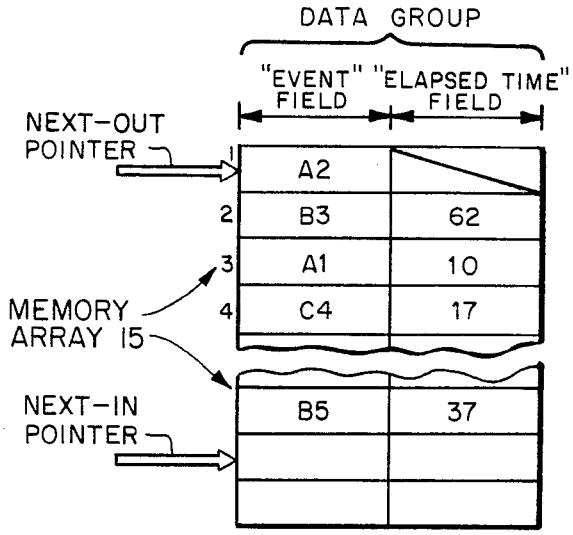
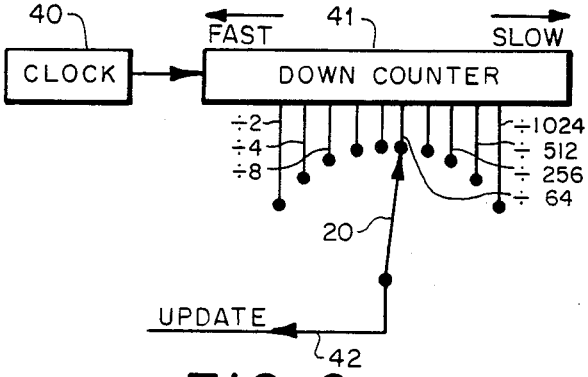
FIG. 6
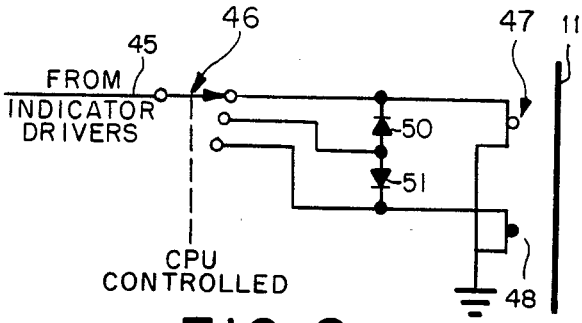
FIG. 9

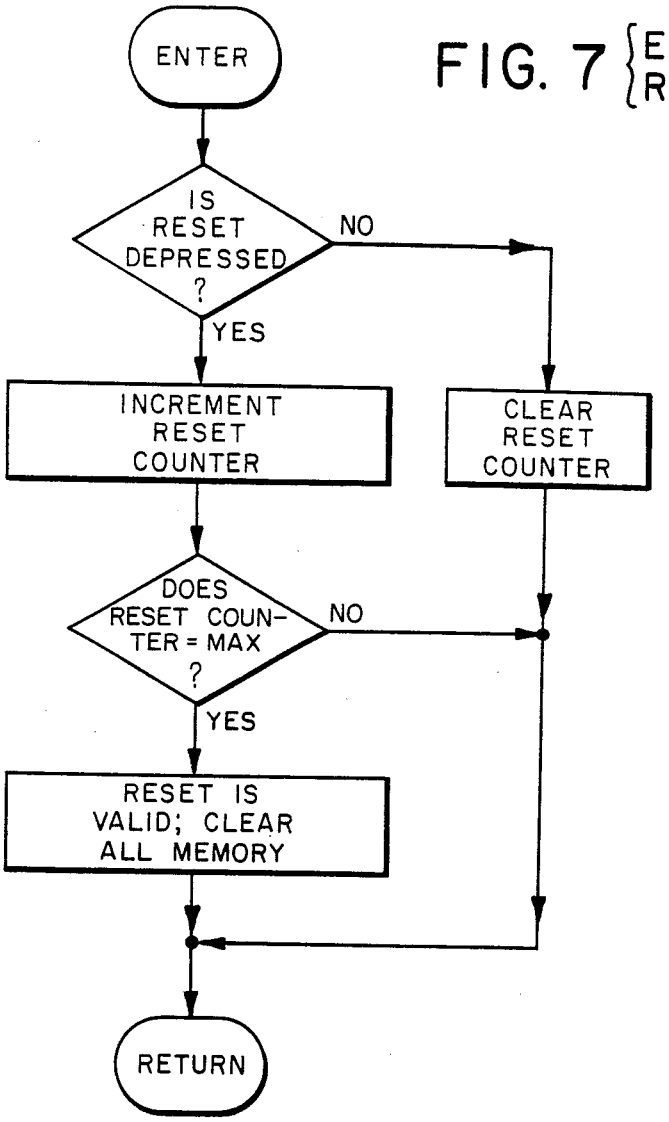
FIG. 7 {ERASE ROUTINE
FIG. 8
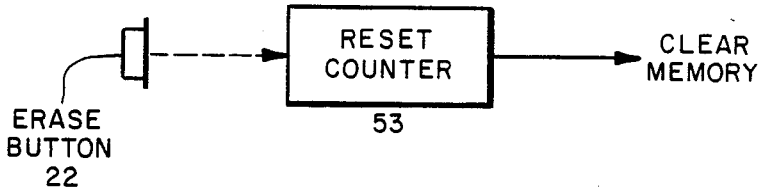

SYSTEM FOR DISPLAYING TIME-RELATED OCCURRENCE OF ALARM-TYPE EVENTS

BACKGROUND OF THE INVENTION

Many alarm detection systems have visual display means, frequently termed annunciators, for indicating the respective locations of detectors which have transmitted alarm signals. Generally, this is done by illuminating a bulb behind a portion of the annunciator display, where the bulb position is related (either by location, the information on the panel in front of the bulb, or some other means) to the location of the alarmed detector. The detectors can sense various alarm-type events, such as window breakage, unauthorized door opening, unauthorized presence in a given physical space, presence of products of combustion, and so forth. Thus when a fire starts and the battalion chief or other official in charge of men and equipment arrives at the fire scene, if the structure has an annunciator panel he can generally tell at a glance which detectors have been alarmed and thus the general extent of the fire at that time.

A shortcoming of present annunciator technology is that the display evident to the arriving fire fighters does not indicate how the fire spread; that is, it does not depict the origin, the direction of spread, or the speed at which the fire progressed. For example, if the fire is spreading five times more rapidly in one direction than another, it is extremely helpful to know this. Further, it is important to know where the fire started, both for bringing the blaze under control and for a subsequent possible arson investigation. Accordingly, it would be most helpful if the arriving supervisor could simply push a button on the annunciator and have it recreate the entire sequence of annunciator panel illumination, but at a rate much faster than the actual rate at which the detectors were alarmed. It is, of course, important that the recreation of the panel information be provided at a rate related to the time differences between successive detector alarms. The present invention is particularly directed to the provision of such an information handling system, particularly suitable with fire and other alarm detection systems.

SUMMARY OF THE INVENTION

The present invention is particularly concerned with the method of providing a graphic display in an information handling system, such as a fire detection and/or a security system. Such a display is provided by the selective identification of discrete areas of a display field, such as different portions of an annunciator panel or different portions of the faceplate of a cathode-ray tube, to represent both event occurrences and the relative elapsed times between successive event occurrences.

The method of the invention includes the steps of receiving data denoting each specific event, such as presence of particles of combustion or unauthorized entry. Next, a data group is assigned to represent each such event; a given data group identifies both a specific event and elapsed time since occurrence of the last previous event. These assigned data groups are stored, and thereafter utilized to selectively identify the discrete areas of the display field at a rate related to the time intervals between event occurrences.

THE DRAWINGS

In the several figures of the drawings, like reference numerals identify like components, and in those drawings;

FIGS. 3, 5 and 7 are flow charts useful in understanding operation of the invention;

FIGS. 4, 6 and 8 are simplified diagrams useful in following the information flow depicted in FIGS. 3, 5 and 7; and FIG. 9 is a partial schematic diagram useful in understanding an optional feature of the invention.

GENERAL SYSTEM DESCRIPTION

Figure 1:
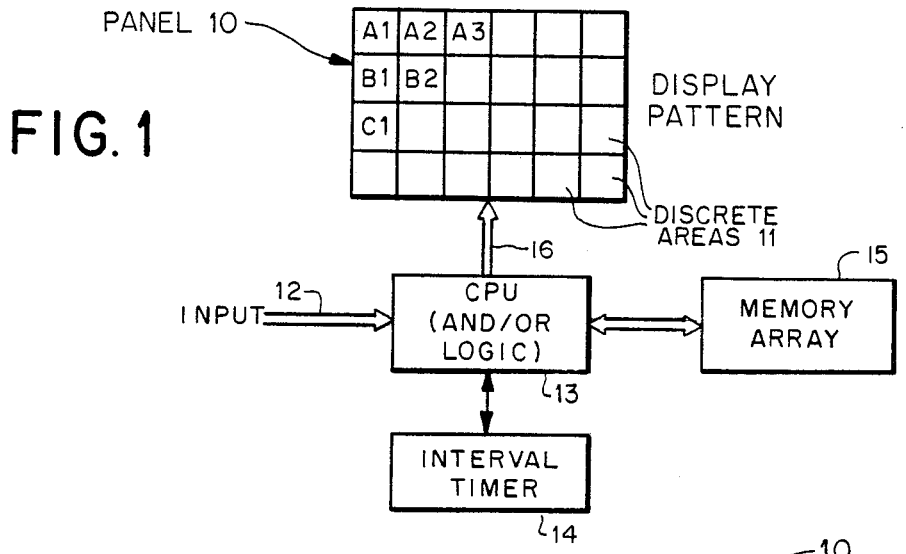
FIG. 1 is a simplified block diagram useful in understanding the organization and operation of the invention.

FIG. 1 shows a typical front panel 10 of an annunciator. That is, a graphic display pattern is provided by dividing the screen into discrete areas or segments 11. These areas can be illuminated by a lamp (not shown) in a conventional manner to indicate an associated detector or device has been alarmed. Legends such as A1, A2, A3, . . . B1, B2, and so forth can be used to correlate the respective discrete areas with the particular detectors then in the alarm state. Different legends can, of course, be overlaid on the display pattern to provide information in any desired pattern. Panel 10 can be the faceplate of a cathode-ray tube (CRT). The faceplate or screen is then "divided" into individual areas as the electron beam strikes selected areas of the faceplate to produce the information display. The beam also produces the desired legends (A1, A2, and so forth) on the screen in any desired pattern. Of course, light-emitting diodes, plasma displays, and other technologies can be used to provide information on the panel. With conventional annunciators, the detector alarm signals are fed directly (through amplifiers or driver stages, not shown) to selectively identify the different discrete areas of the display pattern as the associated detector is alarmed.

Particularly in accordance with the present invention, the data denoting specific events or indicating which detectors have been alarmed are both coupled directly to the display pattern, and are passed over an input line to a central processor unit (CPU) 13. An interval timer 14 is provided and connected to be reset, under control of the CPU, each time data are received over input line 12 denoting an event occurrence. A data group is formed to include both the identification of the specific event and the elapsed time since occurrence of the last event; these data groups are stored in a memory array 15, which is coupled to the CPU 13. The stored data groups are then passed, under control of CPU 13, over output line 16 to selectively identify the appropriate discrete areas 11 of the display pattern at a rate related to the time intervals between event occurrences.

Another important feature of the invention, as will be explained, is the provision of an auxiliary storage means for storing the information previously developed and stored in memory array 15. This feature is important to subsequent reconstruction of events, for example, in an arson investigation, but this feature is not essential to the implementation of the invention in its broader aspects.

The CPU is identified as a "CPU (and/or Logic)" stage 13 because the functions of receiving the event data on line 12, controlling the generation of time interval information in connection with timer 14, storing the data groups thus assigned in memory array 15, and then reading out the stored data groups to sequentially and selectively illuminate different discrete areas of the display pattern, can be accomplished with a logic control circuit. At the present time the use of a semiconductor integrated circuit (IC) is cost effective and is used as part of the preferred embodiment. Those skilled in the art will appreciate that the term "CPU" as used herein and in the appended claims, also embraces logic circuits interconnected to accomplish the same end results.

DETAILED DESCRIPTION OF THE INVENTION

Figure 2:
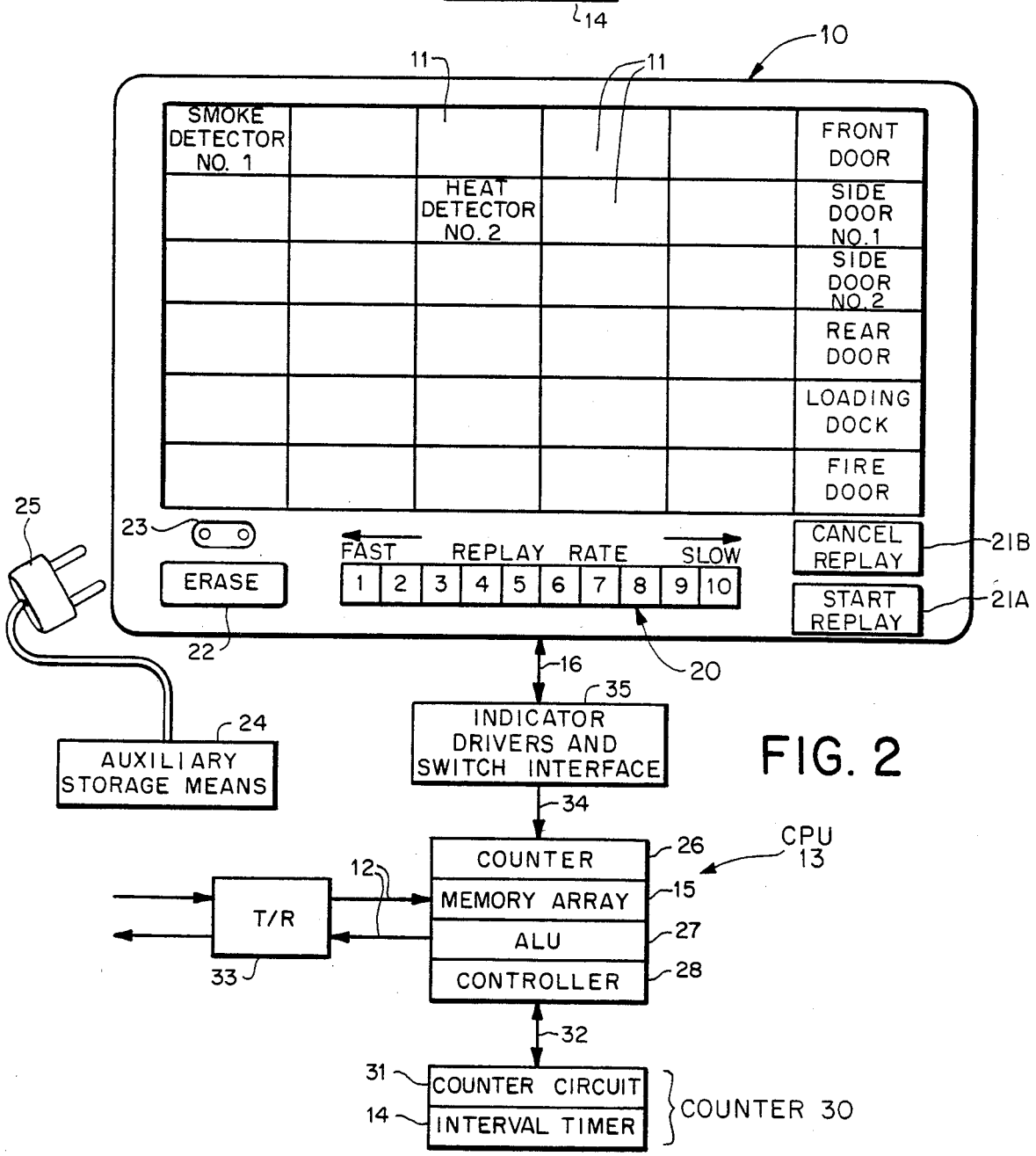
FIG. 2 is a more detailed block diagram of the invention, showing a typical display field.

The display pattern on the front panel of annunciator 10 is shown at the top of FIG. 2. The different types of alarm events, sensed by various detectors (not shown), are represented by the different legends shown on different areas. It is noted that not only fire or heat detection can be represented, but unauthorized entry or other violation of preset, monitored conditions can be depicted. This is information particularly useful in a subsequent arson investigation, where the precise point of entry can be identified and, if adequate sensors are provided, the movement of an intruder from space to space can be documented by sequential identification of the discrete areas 11 and the relative rate of such movement.

The front panel also includes a replay rate switch 20, with 10 different positions referenced 1–10 to select the rate at which the alarm information will be reproduced, as a function of the rate at which the events originally occurred. Those skilled in the art will appreciate there can be a single, fixed replay rate, or a number of different replay rates other than 10, without departing from the principles of this invention. This will become more clear in the subsequent explanation. The reproduction of the successive alarms is initiated by depressing the "start replay" button 21A. The replay sequence thus initiated can be cancelled at any time by pushing the "cancel replay" button 21B. An "erase" means can be provided, and is here shown as a button 22, to effect removal of the contents of the memory which stores the data groups, readying the annunciator and the associated equipment for another cycle of alarm events. Of particular import is the connector 23 which allows for storage of the data groups in an auxiliary means 24 by effecting a coupling between the storage means plug 25 and connector 23, and then depressing the "start replay" button 21A. Auxiliary storage means 24 can be a conventional cassette recorder, or another inexpensive unit for saving the data groups for use in a subsequent investigation. If it is not desired to save the data, the erase means is activated and the memory is effectively wiped out. To prevent accidental erasure, the operating sequence requires the erase button to be depressed for a preset time period.

In FIG. 2, CPU 13 is depicted as including memory array 15, a counter 26, an arithmetic and logic unit (ALU) 27, and a controller 28. A counter 30, which includes interval timer 14 and a counter circuit 31, communicates in both directions over link 32 with the CPU. As shown in FIG. 2, the CPU receives input event-denoting data signals over input line 12, in turn coupled to a communication means such as a transmit-receive switch 33. Output signals can also be passed from the CPU over T/R switch 33 when verification of the arriving data signal is desired. The output data groups are passed from the CPU over another link 34, through a series of indicator drivers and switch interface 35, and link 16 to the individual lamps or other indicators (not shown) which selectively identify the individual segments of the display panel, or illuminate selected portions of a CRT faceplate. Operation of the apparatus of FIG. 2 will be better understood when considering FIGS. 3–6.

Figure 3:
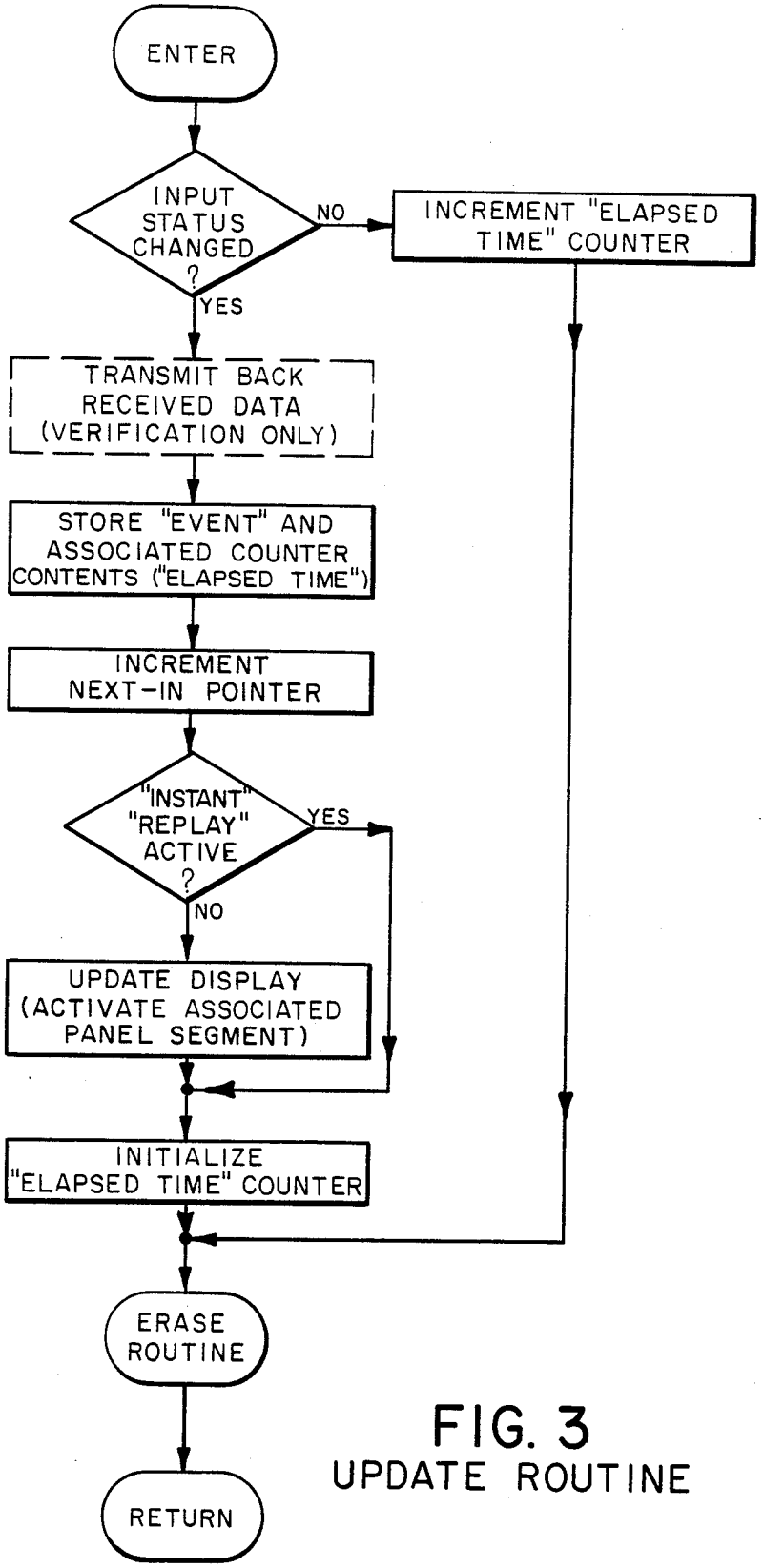

Considering the sequence of steps shown in FIG. 3, the update routine is that sequence of steps which the system of this invention normally goes through as it "looks" for alarm events signalled by incoming data. The update routine (or subroutine) is entered on a periodic, fixed time basis (such as an interrupt). Hence, as this routine commences, the first decision is regarding any change in the input status, that is, the number of detectors or alarm units (if any) then in an alarm condition. If there is no change, the program increments the "elapsed time" counter and then drops out at the return point, to enter the program and cycle through again. If no detectors are alarmed, the elapsed time will accumulate to a maximum value. However, FIG. 4 shows that the first segment of the "elapsed time" field is nulled, and so this value is not used. Hence, if no event type data are received, then the "event" fields in FIG. 4 will all be blank (or zero), and likewise there is no information stored in the elapsed time field.

Considering FIG. 3, if there is a change in input status as depicted by receipt of data over line 12 (FIG. 2), the system can verify the accuracy of the data by transmitting back the data through T/R switch 33 to the data source. If verification is not desired, the next step is to store the data representing the particular event in the "event" field at position 1, the first data group in FIG. 4. At the same time the associated counter contents from the elapsed time counter are also stored in the "elapsed time" field at position 1. As this is the first elapsed time information, and the counter is probably full from having cycled throughout its range before the first event occurred, this information is nulled out as represented in FIG. 4. For all subsequent events the elapsed time information is stored adjacent the related "event" field.

The next step is to increment the next-in pointer as shown in FIG. 4. At the beginning, the next-in and next-out pointers both point to position 1 of memory array 15. The term "pointer" of course does not refer to a physical pointer, but is a conventional data processing term to denote a data sequence containing the address of a particular location in the memory array. This is depicted in FIG. 4 by the analogy of the physical arrow pointing to the memory location. Accordingly, the next-in pointer is incremented to position 2, to identify the memory location at which the next incoming event and elasped time data will be stored.

The system then checks to see whether the "instant replay" routine depicted in FIG. 5 is active at this time. If it is not, the display shown in FIGS. 1 and 2 is updated by activating the associated panel segment. If "instant replay" is active, the updating step is bypassed and the "elapsed time" counter is initialized, that is, reset to zero. The "Erase" routine is then entered, and the steps shown in FIG. 7 are completed. This ends the updating routine, and the system continues to cycle through this sequence of steps to store the information as depicted in FIG. 4.

When start replay means 21A is actuated, the steps depicted in FIG. 5 are commenced. The operating program for effecting these steps is resident in memory array 15. The program first blanks or clears the display of all the alarmed detectors, by deenergizing the driver circuits for the illuminated indicators. Then the system tests the last replay rate selected by actuation of switch means 20, represented in FIG. 6 by a mechanical switch arm. Next, the program sets the next-out pointer (shown in FIG. 4) to the first position of the memory array which holds the data groups, and lights the first indicator lamp or otherwise identifies the appropriate panel segment. In this example "A2" represents the event field of the first data group, and therefore the interval field associated with this event field is not used. This first interval field can be allowed to accumulate a count, but such count is not used in replaying the stored data and thus it need not be stored.

In the next step, the next-out pointer is incremented or moved to position 2; the next data field (B3) holds the next event, and a count representing the elapsed time since occurrence of the previous event is held in the elasped time field of data group 2. This count was developed as explained in connection with FIG. 3.

Next, the update line 42 is tested to determine if it is ready, that is, if a pulse has been passed from clock 40 (FIG. 6) through down counter 41 to that one of the counter output conductors selected by switch arm 20. If the update pulse is not present on line 42, the test is continually made until it occurs. If a sufficient number of clock pulses has been generated so that the divide-down counter has produced an output pulse at the appropriate terminal, a signal is present on the update line 42 and the program goes to the next step. The next step is to decrement "interval"; the original interval value was derived from the "elapsed time" value in the elapsed time field of the data group. For example, the value 62 in the interval counter is successively reduced to 61, 60, 59 and so forth until it reaches zero. The system then cycles through the "decrement interval" sequence, synchronously with the pulses on update line 42, until the contents of "interval" are reduced to zero. At this time the program activates the indicator referenced by the event field in the same data group having the elapsed time value just decremented to zero. Thus, "B3" is activated 62 counts after "A2" is activated, a relative time period determined by the setting of switch 20. By way of example, in the illustrated arrangement of ten successive divide-by-two settings, each clock pulse can be divided down as many as 1,024 times.

The next test in the program is to determine if the event and time difference just displayed were represented by the last data group stored in the memory array 15. This is determined by checking to see whether the next-in and next-out pointers both designate the same memory location. If they do, the last data group has been displayed. If that was the last group, the program is terminated. Otherwise the program branches back to the step where the next-out pointer is incremented, and the next data group, representing the event information (A1) in the next field and the associated elasped time information (10) is loaded. Those skilled in the art will readily understand the implementation of this straightforward sequence of program steps.

Since the depression of erase button 22 clears all data from memory array 15, it is mandatory, for optimum operation, to minimize the possibility of accidental activation of the erase process. A simple means for preventing inadvertent clearing of the memory is to require that erase button 22 be depressed, and then maintained depressed, for an abormally long period of time, for example, from 10 to 30 seconds. The erase routine shown in FIG. 7, which is part of the "Update Routine" FIG. 3, is included to utilize the periodic, fixed time sequencing through the update routine to time the actual depression of erase switch 22 and prevent accidental clearing of memory 15.

Reset counter 53 (FIG. 8) provides the means for determining the length of time that erase button 22 has been depressed. The value within the reset counter is incremented while the erase button 22 is depressed, and when the accumulated value reaches a predetermined maximum (selected to correspond to a given time delay, such as 15 seconds), the system will react by clearing its memory array 15. At any time that erase button 22 is determined to be not depressed, the reset counter 53 is cleared (loaded with a value of zero). This routine is shown in FIG. 7.

It may be desirable under some conditions to display at least two types of information in only one discrete segment of the front panel or display pattern. For example, if a single monitored space contains both a heat detector (which responds to rate of temperature rise) and a second detector to indicate the presence of particles of combustion, an orange lamp could be lighted to indicate an excessive temperature rise in a given time period, while a red lamp could be illuminated to denote the presence of particles of combustion in the same space. FIG. 9 depicts such an arrangement in simplified form. Line 45 receives a signal from one of the driver circuits, and with switch 46 in the position illustrated, lamp 47 would be illuminated in front of discrete area 11. When switch 46 is displaced to its lowermost position the other lamp 48 is energized. With switch 46 in its center position, a circuit is completed over diodes 50, 51 to energize both lamps 47 and 48. An alternate arrangement is to use the same lamp, and in the second path provide an oscillator or other switching arrangement to produce a flashing signal behind the segment, instead of a continuous signal. Other approaches to display two types of information behind a single panel segment will be apparent to those skilled in the art.

The event field which has been described as containing various identifications of specific alarmed units could also include a piece of information such as "ALARM" or "TROUBLE". The modification or changing of the information displayed on the front panel is simplified if the panel is the front surface of a cathode-ray tube used in a monitor or video display terminal. By simply changing the information fed to the controlling grids of the tube any desired information can be portrayed in virtually any pattern. Of course, plasma displays, light-emitting diodes, and related selective illumination devices can also be used to provide the desired information on the front panel.

TECHNICAL ADVANTAGES

The present invention provides a very real advantage for fire fighters arriving on the scene of a blaze. The official in charge must know the construction of the structure and its present contents in advance, and generally has only about 30 seconds or less to assess the state of the fire, and decide on strategy for bringing the blaze under control. The invention makes it possible to determine in only a few seconds precisely where the fire started, and in which direction, and how quickly, it spread. This is a substantial advance over previous systems, and is extremely useful to the fire fighters on the scene.

Another substantial advantage is the provision of means for recording the data groups identifying the time sequence of alarms, with a specific identification of those detectors alarmed at each point in the sequence. With the present trend to overall structure management, often access control and other monitors are added to the system. The resultant information saved from the system memory will depict events such as unauthorized entrance as well as alarming of successive detectors. Such information is invaluable in an arson investigation, and is not now available to the law enforcement officials.

The term "event occurrence", as used herein and in the appended claims, refers to a change in a monitored condition.

In the appended claims the term "connected" means a connection between two components such that an electrical current can flow between those components. The term "coupled" indicates there is a functional relationship between two components, with the possible interposition of other components and/or elements (including air) between the two components or elements described as "coupled" or "intercoupled".

While only a particular embodiment of the invention has been described and claimed herein, it is apparent that various modifications or alterations of the invention may be made. It is therefore the intention in the appended claims to cover all such modifications and alterations as may fall within the true spirit and scope of the invention.

What is claimed is:

1. The method of providing a graphic display in an information system, such as a fire and/or security system, by selective identification of discrete areas of a display pattern to represent both event occurrences and the relative elapsed times between successive events, comprising the steps of:

receiving data denoting specific events;

assigning a data group to represent each event, which data group identifies both the event and the elapsed time since occurrence of the last event;

storing the successive data groups; and utilizing the stored data groups in the selective identification of the pattern discrete areas at a rate related to the time intervals between event occurrences.

2. The method described in claim 1, in which the rate at which the discrete areas are selectively identified is adjustable.

3. The method described in claim 1, in which different areas of the pattern are identified to indicate different specific event occurrences.

4. The method described in claim 1, and further comprising providing a train of timing pulses, and using said timing pulses in the assignment of that portion of each data group denoting the elapsed time since occurrence of the last event.

5. The method described in claim 1, and further comprising providing auxiliary means for storing the successive data groups, to maintain the information contained in said data groups after the discrete areas have been selectively identified.

6. The method described in claim 1, in which each discrete area is capable of displaying at least two types of information when selectively identified by one of said stored data groups.

7. The method described in claim 1, and further comprising the step of clearing the stored data groups from the information system.

8. The method described in claim 7, in which the selective clearing is effected only after determining that the request for clearing is not accidental.

9. The method of providing a graphic display in a system for handling a plurality of data types, such as a fire and/or security data, by selective identification of one or more discrete areas of a display pattern to represent both event occurrences and the relative elapsed times between successive events, comprising the steps of:

receiving data denoting specific events;

assigning a data group to represent each event, which data group identifies both the event and the elapsed time since occurrence of the last event;

storing the successive data groups; and utilizing the stored data groups in the selective identification of the pattern discrete areas at a rate related to the time intervals between event occurrences.

10. The method of providing a graphic display in an information handling system, such as a fire and/or security system, by selective identification of discrete areas of a display pattern to represent both event occurrences and the relative elapsed times between successive events, comprising the steps of:

receiving data denoting different, successive specific events;

accumulating a value of timing pulses representing the time interval between a first specific event represented by the received data and the next successive specific event thus represented;

forming a data group upon receipt of data denoting each specific event, which data group comprises a first field including information identifying a specific event and a second field identifying the elapsed time since occurrence of the next previous specific event;

storing the successive data groups; and utilizing the stored data groups to selectively identify different ones of the discrete areas at a rate related to the time intervals between event occurrences as represented by the data stored in the second field of each data group.

11. A graphic information display system for representing both event occurrences and the relative elapsed times between successive events, comprising:

a display pattern, subdivided into discrete areas;

a counter for accumulating a count;

input means for receiving data denoting specific events;

means, including a central processor unit, coupled to said input means and to said counter, for forming successive data groups, each of which identifies both a specific event and the elapsed time since occurrence of the last event;

a memory array, coupled to the central processor unit, for storing a plurality of said data groups; and means, including the central processor unit, for utilizing the data groups stored in the memory array to selectively identify discrete areas of the display pattern at a rate related to the elapsed time information stored in the data groups.

12. A graphic information display system as claimed in claim 11, and further comprising counter means, coupled to said central processor unit, for accumulating a count indicating the elapsed time between successive pairs of event occurrences.

13. A graphic information display system as claimed in claim 11, and further comprising an adjustable down counter, coupled to the central processor unit, for varying the rate at which the discrete areas of the display pattern are selectively identified.

14. A graphic information display system as claimed in claim 11, and in which said system includes a connector, coupled to the memory array, such that an auxiliary storage means can be coupled through said connector to receive and store the data groups previously stored in the memory array.

15. A graphic information display system as claimed in claim 11, and further comprising means, associated with at least one discrete area of the display pattern, for displaying at least two types of information in the one discrete area.

16. A graphic information display system as claimed in claim 11, and further comprising erase means, coupled to said memory array, for selectively clearing the memory array when the erase means is actuated.

17. A graphic information display system as claimed in claim 16, and further comprising a reset counter, coupled between said erase means and said memory array, for delaying the clearing of the memory array for a preset time after the erase means is actuated, thus preventing accidental clearing of the memory array.

* * * * *